US011751610B2

(12) United States Patent
Berger et al.

(10) Patent No.: US 11,751,610 B2
(45) **Date of Patent: *Sep. 12, 2023**

(54) SWIMSUIT WITH SEAMLESS BACK AND TENSION BANDS

(71) Applicant: TYR Sport, Inc., Farmingdale, NY (US)

(72) Inventors: Jared Berger, Farmingdale, NY (US); Matthew Vito DiLorenzo, New York, NY (US); Joseph DiLorenzo, Laurel Hollow, NY (US)

(73) Assignee: TYR Sport, Inc., Farmingdale, NY (US)

( * ) Notice: Subject to any disclaimer, the term of this patent is extended or adjusted under 35 U.S.C. 154(b) by 155 days.

This patent is subject to a terminal disclaimer.

(21) Appl. No.: 17/132,760

(22) Filed: Dec. 23, 2020

(65) Prior Publication Data

US 2021/0112890 A1 Apr. 22, 2021

Related U.S. Application Data

(62) Division of application No. 16/155,148, filed on Oct. 9, 2018, now Pat. No. 10,897,936.

(51) Int. Cl.
*A41D 7/00* (2006.01)

(52) U.S. Cl.
CPC ..... *A41D 7/005* (2013.01); *A41D 2600/10* (2013.01)

(58) Field of Classification Search
CPC ..... A41D 7/005; A41D 13/00
USPC ..... 2/67
See application file for complete search history.

(56) References Cited

U.S. PATENT DOCUMENTS

| | | | | |
|---|---|---|---|---|
| 5,819,322 | A * | 10/1998 | Dicker | A42B 3/0493 2/456 |
| D413,424 | S | 9/1999 | Davies et al. | |
| D416,124 | S | 11/1999 | Davies et al. | |
| D423,189 | S | 4/2000 | Davies et al. | |
| D456,109 | S | 4/2002 | Fairhurst et al. | |
| D456,110 | S | 4/2002 | Fairhurst et al. | |
| D456,111 | S | 4/2002 | Fairhurst et al. | |
| D456,588 | S | 5/2002 | Fairhurst et al. | |
| D460,242 | S | 7/2002 | Fairhurst et al. | |
| D461,033 | S | 8/2002 | Fairhurst et al. | |
| D461,034 | S | 8/2002 | Fairhurst et al. | |
| D462,154 | S | 9/2002 | Fairhurst et al. | |
| 6,446,264 | B2 | 9/2002 | Fairhurst et al. | |
| D518,276 | S | 4/2006 | Fairhurst et al. | |

(Continued)

FOREIGN PATENT DOCUMENTS

| | | |
|---|---|---|
| EP | 1110464 A2 | 6/2001 |
| EP | 1250858 A1 | 10/2002 |

(Continued)

*Primary Examiner* — Timothy K Trieu
(74) *Attorney, Agent, or Firm* — STETINA BRUNDA GARRED AND BRUCKER

(57) ABSTRACT

A swimsuit for competition swimming is contemplated as being formed with a seamless, continuous external surface across the rear of the lower torso and thigh portions of the swimsuit, and with a network of tension bands disposed interior to the external surface of the swimsuit for storing energy and resisting motion. The swimsuit may optimize the swimmer's swimming motion and posture, and improve the flow of water over and off of the swimsuit during competition.

3 Claims, 4 Drawing Sheets

(56) References Cited

U.S. PATENT DOCUMENTS

| | | | | |
|---|---|---|---|---|
| D541,008 | S | 4/2007 | Fairhurst et al. | |
| D579,629 | S | 11/2008 | Rance et al. | |
| D579,630 | S | 11/2008 | Rance et al. | |
| D579,631 | S | 11/2008 | Rance et al. | |
| D579,632 | S | 11/2008 | Rance et al. | |
| D579,633 | S | 11/2008 | Rance et al. | |
| D584,484 | S | 1/2009 | Rance et al. | |
| D586,081 | S | 2/2009 | Rance et al. | |
| D586,082 | S | 2/2009 | Rance et al. | |
| D593,728 | S | 6/2009 | Rance et al. | |
| D601,778 | S | 10/2009 | Rance et al. | |
| D606,283 | S | 12/2009 | Rance et al. | |
| 8,196,220 | B2 | 6/2012 | Rance et al. | |
| 8,286,262 | B2 | 10/2012 | Rance et al. | |
| 9,144,252 | B1 * | 9/2015 | Kostrzewski | A41D 1/08 |
| 9,661,880 | B2 | 5/2017 | Waller et al. | |
| D789,034 | S | 6/2017 | Musciacchio | |
| D794,279 | S | 8/2017 | Musciacchio | |
| D795,530 | S | 8/2017 | Musciacchio | |
| 9,763,483 | B2 | 9/2017 | Waller et al. | |
| D803,521 | S | 11/2017 | Musciacchio | |
| D806,358 | S | 1/2018 | Flockton et al. | |
| D806,360 | S | 1/2018 | Musciacchio | |
| 9,854,853 | B2 | 1/2018 | Musciacchio | |
| 9,895,569 | B2 * | 2/2018 | Yao | A63B 21/4005 |
| 2001/0014981 | A1 | 8/2001 | Fairhurst et al. | |
| 2004/0255358 | A1 * | 12/2004 | Ota | A41D 31/18 2/69 |
| 2008/0141430 | A1 | 6/2008 | Rance et al. | |
| 2008/0141431 | A1 | 6/2008 | Rance et al. | |
| 2014/0090142 | A1 | 4/2014 | Waller et al. | |
| 2014/0096301 | A1 | 4/2014 | Waller et al. | |
| 2014/0250561 | A1 | 9/2014 | DiLorenzo | |
| 2015/0201682 | A1 | 7/2015 | Musciacchio | |
| 2017/0172224 | A1 | 6/2017 | Joseph | |
| 2017/0245561 | A1 | 8/2017 | Flockton, et al. | |
| 2017/0265536 | A1 | 9/2017 | Flockton et al. | |
| 2017/0280791 | A1 | 10/2017 | Spenser et al. | |
| 2018/0280791 | A1 * | 10/2018 | Eno | G07F 17/326 |

FOREIGN PATENT DOCUMENTS

| | | | |
|---|---|---|---|
| EP | 1935265 | A2 | 6/2008 |
| EP | 1935266 | A2 | 6/2008 |
| EP | 2713785 | A1 | 4/2014 |
| EP | 2713786 | A1 | 4/2014 |
| EP | 2877621 | A1 | 6/2015 |
| EP | 3102059 | A1 | 12/2016 |
| EP | 3182848 | A1 | 6/2017 |
| WO | 2012164300 | A1 | 12/2012 |
| WO | 2012164301 | A1 | 12/2012 |
| WO | 2014016643 | A1 | 1/2014 |
| WO | 2015117646 | A1 | 8/2015 |
| WO | 2016027068 | A1 | 2/2016 |
| WO | 2016027071 | A1 | 2/2016 |
| WO | 2017144938 | A1 | 8/2017 |
| WO | 2017144940 | A1 | 8/2017 |

* cited by examiner

SWIMSUIT WITH SEAMLESS BACK AND TENSION BANDS

CROSS-REFERENCE TO RELATED APPLICATIONS

The present application is a divisional of U.S. patent application Ser. No. 16/155,148, filed Oct. 9, 2018, the entire disclosure of which is expressly incorporated herein by reference.

STATEMENT RE: FEDERALLY SPONSORED RESEARCH/DEVELOPMENT

Not Applicable

BACKGROUND

1. Technical Field

The present disclosure relates generally to the field of sports garments. More particularly, the present disclosure relates to swim suits or swim garments for water sports activities, especially competitive swimming.

2. Related Art

In the sport of competitive swimming, the ever-increasing levels of performance by elite athletes, aided by advances in nutrition, training, and especially swimsuit technology, has resulted in a continual rewriting of the record books. While FINA's prohibition in 2009 on body-length and non-textile swimsuits has dialed back the use of certain more extreme technologies, it is still of critical importance that elite competitors use the most effective and up-to-date swimsuit technology in order to optimize their performance within the rules and the competitive spirit of the sport. Today, no major Olympic or world record in men's or women's competitive swimming has stood unbroken for more than a decade, and every year new records continue to be set and exceeded at a tremendous rate.

At the 2016 Olympics in Rio de Janeiro, athletes representing the United States broke multiple world records, highlighted by Katie Ledecky's four gold medals and the setting of world records in both the women's 400-meter and 800-meter freestyle. United States Olympians Lilly King and Simone Manuel, who each won two gold medals at the 2016 Olympics, participated in the setting of five world records at the 2017 FINA World Championship in Budapest, Hungary. There, Lilly King set world records in the women's 50-meter and 100-meter breaststroke, Simone Manuel anchored the world record setting team in the 4×100-meter mixed freestyle, and the two together formed half of the world record setting teams in the 4×100-meter mixed medley (joined by Matt Grevers and Caeleb Dressel) and the 4×100-meter women's mixed medley (joined by Kathleen Baker and Kelsi Worrell). Just recently, on May 16, 2018, Katie Ledecky set a world record in the women's 1500-meter freestyle event at the Tyr Pro Swim Series in Indianapolis, Ind.

It may still be seen that swimmers require the best swimsuit technology to perform at the highest level, and that as the boundaries of human performance continue to be pushed, technology must be developed to support those advances.

Therefore, there is a need in the art for improved swimsuits that improve upon and eliminate the deficiencies of prior swimsuits.

BRIEF SUMMARY

To solve these and other problems, a swimsuit is contemplated as being formed of an external surface, with that external surface being continuous and seamless along at least the rear of the lower torso portion, the rear of the two thigh portions, and the junction therebetween. Under the external surface is disposed a number of strategically positioned tension bands that coordinate together to resist motion and to store energy during swimming.

The swimsuit is formed of at least a lower torso portion and two upper thigh portions, which are configured to be worn over and compress against the lower torso and the upper thighs of the swimmer. The swimsuit comprises an external surface, with the external surface across at least the rear of the lower torso portion, the rear of the two thigh portions, and the junction therebetween being formed from a continuous, seamless external surface material. At least three groups of tension bands are disposed interior to the external surface of the swimsuit, each tension band within a group of tension bands being configured to have a tensile elasticity along its longitudinal axis greater than the tensile elasticity of the external surface material. The at least three tension bands may be chosen from among the following groups of tension bands:

a) a central rear torso band extending rearward from a perineum region of the swimsuit and vertically upward along the rear centerline of the lower torso region of the swimsuit.

b) a pair of side torso bands, each side torso band extending laterally rearward from the perineum region, upward and around a respective side of the lower torso region, and at least to a front of a waistband region of the swimsuit.

c) an inner thigh band extending upward along one inner thigh region of one thigh portion, across the perineum region, and downward along the other inner thigh region of the other thigh portion.

d) a pair of rear thigh bands, each rear thigh band extending upward across a rear of a respective one of the thigh portions, across the lower torso portion, and at least to a rear of the waistband region.

e) a pair of front thigh bands, each front thigh band extending upward across a front of a respective one of the thigh portions and extending to the lower torso portion.

f) a pair of front torso bands, each front torso band extending from the perineum region at least to the front of the waistband region.

The plurality of the tension bands may be disposed on the interior surface of the swimsuit, or may be disposed between and interior surface of the swimsuit and the exterior surface of the swimsuit. The external surface material may comprise a woven fabric, which may comprise a blend of nylon of spandex. The swimsuit may be configured in styles such as a jammer style swimsuit, a square-brief style swimsuit, or may be configured as further comprising an upper torso portion configured to be worn over a front of the swimmer's upper torso, as in, for example, a racerback-style swimsuit. The swimsuit may comprise at least four of the six groups of tension bands, or at least five of the six groups of tension bands, or all six of the six groups of tension bands.

Certain embodiments of the herein contemplated swimsuits may further comprise an upper torso portion configured to be worn over at least a front of the swimmer's upper torso. Certain tension bands, if included in the swimsuit, may extend to and be incorporated in the upper torso portion of the swimsuit.

For example, in a swimsuit including the pair of side torso bands, each side torso band may additionally traverse the front waistband region of the swimsuit, traverse across the centerline of the swimsuit, and extend to at least an underarm region of the swimsuit. In a swimsuit including the pair of rear thigh bands, each rear thigh band may additionally traverse the rear waistband region of the swimsuit and extend to at least a side upper torso region of the swimsuit. In a swimsuit including the pair of front torso bands, each front torso band may additionally traverse the front waistband region, traverse across a side upper torso portion of the swimsuit, and extend to at least a rear upper torso region of the swimsuit.

The swimsuit may also further comprise an additional rear waistband tension band extending laterally along the rear waistband region of the swimsuit. Each end of the rear waistband tension band may additionally extend around both sides of the lower torso region to at least a front waistband region of the swimsuit. In particular embodiments, each end of the rear waistband tension band may additionally traverse the front waistband region of the swimsuit, intersect with the other end of the rear tension band at the front centerline of the swimsuit, and extend to at least and underarm region of the swimsuit.

The tension bands may be configured in a variety of different ways according to the competitive or stylistic desires of the swimmer. For example, in a jammer style swimsuit, the front thigh bands may extend around the side of the lower torso portion and extend at least to a rear of the waistband region.

BRIEF DESCRIPTION OF THE DRAWINGS

These and other features and advantages of the various embodiments disclosed herein are better understood with respect to the following descriptions and drawings, in which.

Common reference numerals are used throughout the drawings and the detailed description to indicate the same elements.

DETAILED DESCRIPTION

According to various aspects of the present disclosure, a new and improved swimsuit is contemplated as having an external surface, with the external surface at the junction between across the entirety of the rear of the lower torso portion, the rear of the two thigh portions, and the junction therebetween is formed from a continuous, seamless external surface material, which served to more efficiently reduce drag, maximize a swimmer's velocity through the air and water, and shed moisture. Disposed interior to the external surface is a system of tension bands which serve to optimally position the swimmer's body during swimming by resisting motion to a suboptimal swimming position, and to optimize the storage and release of energy during the swimmer's motions.

Figure 1:
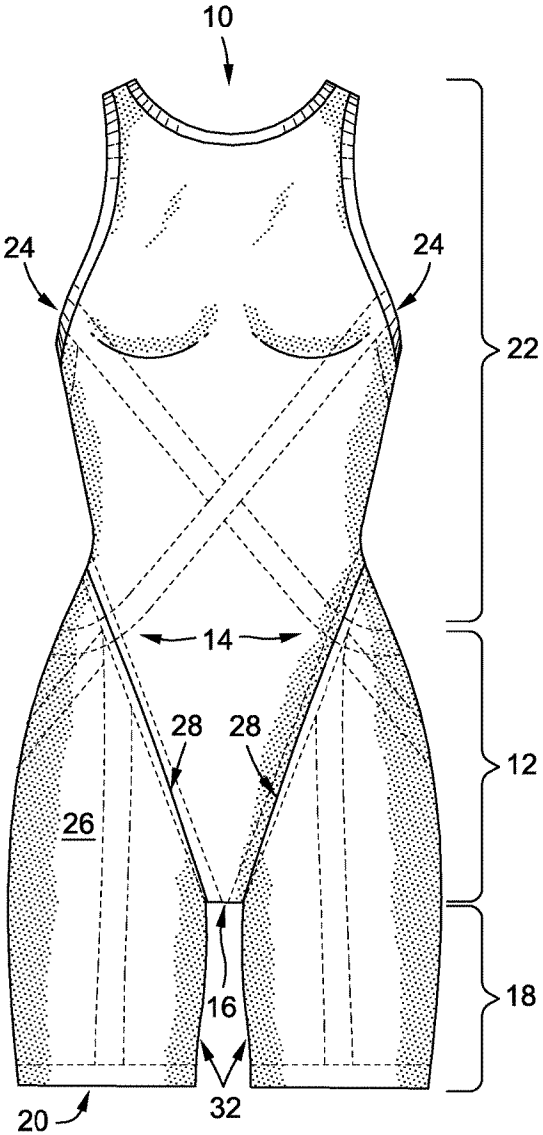
FIG. 1 is a front view of a first exemplary embodiment of a racerback-style swimsuit according to the present disclosure.

Turning now to FIG. 1, a front view of an exemplary embodiment of a swimsuit 10 of the present disclosure is shown, the illustrated embodiment having a racerback-style configuration typically worn by women competitive swimmers. As may be seen in the illustration of this exemplary embodiment, such a swimsuit 10 may have a lower torso portion 12 generally configured to be worn over and compress against the swimmer's lower torso. For purposes of this disclosure, in order to maintain consistent terminology between different configurations of embodiments, the lower torso portion 10 is to be understood as the portion of the swimsuit including a waistband region 14 of the swimsuit 10 configured to be worn at the waist of the swimmer, a perineum region 16 of the swimsuit configured to be worn between the legs at the base of the groin, and all areas of the swimsuit vertically between these two regions as would be worn upon a swimmer in a standing position, which is the orientation shown in FIG. 1 and all other figures.

The swimsuit 10 may also have two thigh portions 18 configured to be worn over and compress against at least part of each of the swimmer's thighs. In the exemplary embodiment of FIG. 1, it may be seen that each thigh portion 18 extends over at least the upper thighs of the swimmer, but terminates above the knee. It may also be seen, however, that according to other embodiments, such as men's square-leg style swimsuits, the thigh portions 18 may be very short, while in other embodiments, the thigh portions may be extended, perhaps to the knee or even further. For purposes of this disclosure, the thigh portions 18 shall be understood as comprising all areas of the swimsuit vertically below the perineum region 16 as would be worn upon a swimmer in a standing position and as shown in the figures. Optionally, in certain embodiments, the thigh portions 18 may include at their base or at other portions an annular leg band 20 for applying additional compressive force and/or being formed of a gripping or water-resistant material, in order to reduce the chance of a thigh portion 18 moving out of position on the swimmer and bunching or creasing, and to prevent the intrusion of water into the area between the swimsuit and the body of the swimmer, either of which would reduce the swimmer's performance by altering the hydrodynamic profile of the swimmer, discomforting the swimmer, and/or requiring the swimmer to carry additional mass.

The swimsuit 10 may also have an upper torso portion 22 configured to be worn over at least a portion of the front of the swimmer's upper torso. It may be seen that this upper torso portion 22 may be included on, for example, the razorback style embodiment shown and illustrated in FIG. 1, as well as bodysuit-style swimsuits for any gender, and may not be included on other embodiments of swimsuits as presently contemplated, such as jammer or square-leg styles of swimsuit. For purposes of this disclosure, the upper torso portion 22 shall be understood as comprising all areas of the swimsuit 10 vertically above the waistband region 14. In the exemplary razorback style embodiment shown in FIG. 1, the upper torso portion 22 extends to at least the shoulder of the swimmer, and has an underarm region 24 in the area of the lower hemisphere of the aperture in in the illustrated swimsuit where the arms of the swimmer would protrude. In embodiment which may include swimsuit elements covering the swimmer's arms instead of apertures for arms, it may be seen that the underarm region 24 would be positioned at about the same location.

It is contemplated that a swimsuit 10 may have an external surface 26. The external surface may be formed of any material suitable for use in a swimsuit, such as a fabric. In the exemplary embodiment, the external surface is a woven fabric formed of a blend of nylon and spandex. The external surface may itself serve to compress against the swimmer, or there may be further inclusions in the swimsuit which apply compression, such as one or more layers under the external surface. The external surface may be formed of the same material across the entirety or majority of the swimsuit, or may be formed of different materials. In the exemplary embodiment illustrated in FIG. 1, the external surface 26 is formed of two continuous panels of material joined together via a pair of torso seams 28, illustrated with a solid line, in a "v" configuration, with the bottom tip of the "v" located at the perineum region 16. When viewed from the front, the "v" configuration of the torso seams 28 is apparent, with each torso seam 28 traveling diagonally upwards towards a front side of the waistband region 14, and proceeding around the side of the upper torso portion 22 towards the upper back of the swimsuit, as more fully illustrated in FIGS. 2 and 3. However, it may be seen that in other embodiments, other configurations of seams may be utilized to joint together panels of material of the external surface 26.

Figure 2:
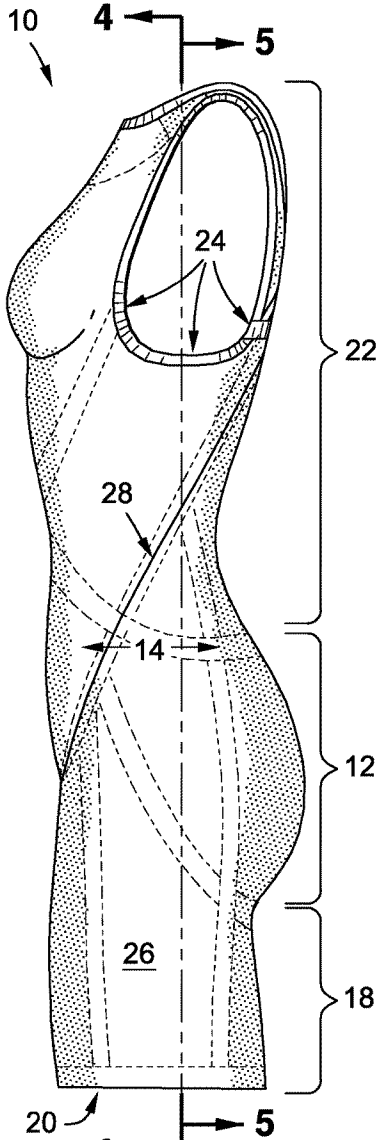
FIG. 2 is a side view of the racerback-style swimsuit embodiment shown in FIG. 1.

Turning now to FIG. 2, a side view of the exemplary embodiment of the swimsuit 10 of FIG. 1 is shown. As may be seen, the two-panel construction of the exemplary swimsuit 10 with the "v" shaped torso seam 28 configuration is further shown. It may be seen how each of the torso seams 28 may continue up from the front of the waistband region 24 and around the side of the upper torso portion 22. As such, the entirety of the external surface 26 across the rear of the lower torso portion and the rear of the two thigh portions, and the previously defined junctions therebetween, is configured to be formed of an entirely continuous and seamless panel of material. This seamless, continuous construction of the external surface, which, in the illustrated exemplary razorback-style embodiment, also is continuous and seamless with some of the rear of the upper torso portion, serves to enhance the performance of the swimmer. By providing a seamless, continuous material across this area, it may be seen that the aerodynamic and hydrodynamic profile of the swimmer may be optimized, as there are no seams which would otherwise result unwanted drag, eddies, or other disruptions. Furthermore, the positioning of this continuous, seamless surface positioned in this area may serve to optimize the rapid dispersion of water away from the swimmer when the relevant portions of the swimsuit are above water, such as during freestyle events. Not only does the presence of seams result in diminished streamlining, but the presence of seams on the portions of the swimsuit that transition above and below the waterline may result in the carrying of quantities of water on the swimmer's body above the waterline that add to the swimmer's mass, reducing the swimmer's velocity through the water. Without seams on these portions of the swimsuit, water that is carried on the swimmer's body above the waterline will tend to more rapidly flow off the swimmer without obstruction, resulting in a an optimization of the swimmer's velocity.

Figure 3:
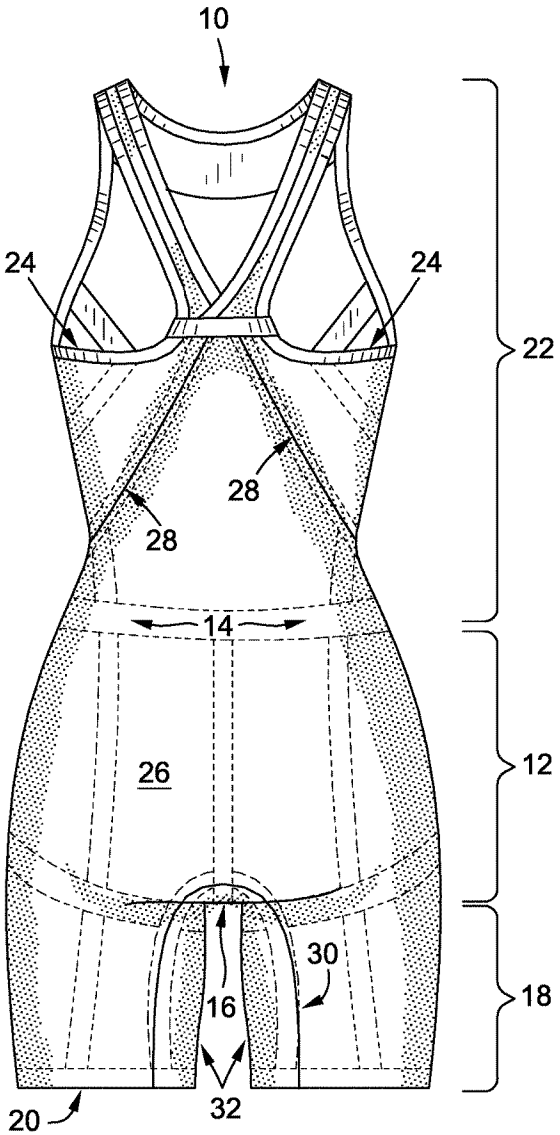
FIG. 3 is a rear view of the racerback-style swimsuit embodiment shown in FIG. 1.

Turning now to FIG. 3, a rear view of the embodiment of a swimsuit 10 illustrated in FIG. 1 is shown. As may be seen by FIG. 3, the external surface 26 across the rear of the lower torso portion 12, the rear of the two thigh portions 18, and the junction therebetween is formed of a continuous, seamless external surface material. It may additionally be seen that according to this embodiment, an additional inner thigh seam 30 may be positioned at the inner thigh region 32 of the swimsuit to join together the material of the external surface 26 of the annular thigh portions 18, with the inner thigh seam 30 running up the inner thigh region 32 of one of the thigh portions 18, across the perineum region 16, and down the inner thigh region 32 of the other of the thigh portions 18. In this manner, it may be seen that because the majority of the inner thigh seam 30 will be positioned essentially axial with the direction of motion of the swimmer's body during swimming, and will be shielded by the swimmer's body from direct exposure to oncoming water during front-facing swimming strokes, such as the freestyle or breaststroke, the diminishment in hydrodynamic efficiency caused by the presence of this inner thigh seam 30 will be minimized.

Figure 5:
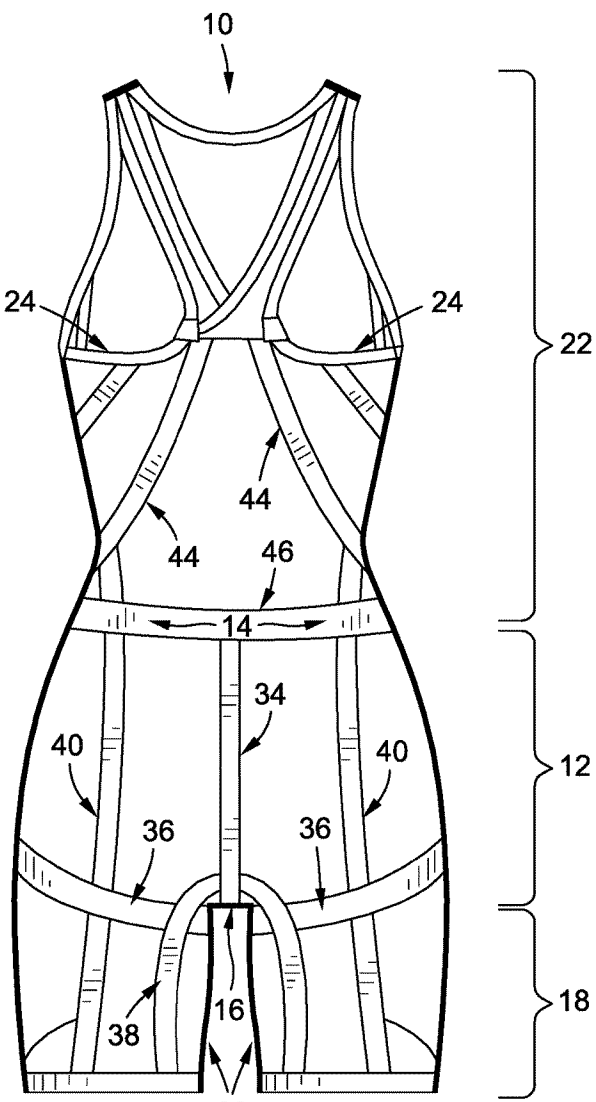
FIG. 5 is a rear internal view of the racerback-style swimsuit embodiment shown in FIGS. 1-3.
Figure 4:
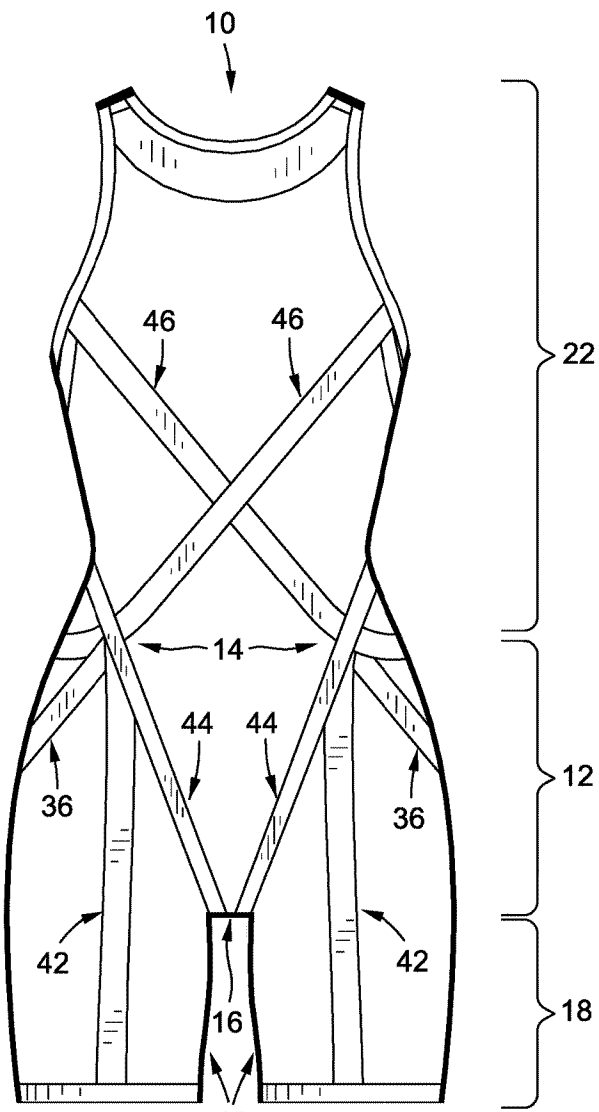
FIG. 4 is a front internal view of the racerback-style swimsuit embodiment shown in FIGS. 1-3.

Turning now to FIGS. 4 and 5, front and rear internal views of the embodiment illustrated in FIGS. 1-3 is illustrated, with the internal features shown in dotted lines in FIGS. 1-3 now more fully shown. As may be seen from FIGS. 1-5, groups of tension bands may be disposed interior to the external surface 26 of a swimsuit 10, with these tension bands serving to coordinate together to resist motion and to store energy during the motions of the swimmer during swimming, so as to maintain an optimal body position and to optimize the swimming mechanics of the swimmer. The tension bands may be visibly disposed on the interior surface of the swimsuit, or embedded within an interior side of the swimsuit, or may be disposed at an interior portion of the swimsuit between the external surface and an internal layer, or in other configurations. Each tension band may be configured to have a tensile elasticity along its longitudinal axis greater than the tensile elasticity of the external surface material, promoting a greater resistance to motion along the long axis of the tension bands in the swimmer, and a corresponding storing and release of energy during the swimmer's movement. Depending on the degree of tensile elasticity of the tension bands and other configuration changes, it is also contemplated that embodiments of the herein disclosed swimsuits may also be configured to make the swimmer's swimming motion substantially more difficult, which may be desirable in a training swimsuit for improving a swimmer's strength and range of motion. In the exemplary embodiment of FIGS. 1-5, six groups of tension bands are illustrated. It may be seen in different embodiments of a swimsuit 10 according to the present disclosure, different combinations of these groups of tension bands may be utilized. For example, while the exemplary embodiment may include all six groups of tension bands, the inclusion of all six groups is not necessary, and embodiments are contemplated which include two, three, four, or five of the groups of tension bands, in various combinations.

A first contemplated group of tension bands may comprise a central rear tension band 34 which extends rearward from a perineum region of the swimsuit and vertically upward along a rear centerline of the lower torso portion of the swimsuit. In certain embodiments, the central rear tension band 34 may extend to the rear waistband region 14. In other embodiments, the central rear tension band may extend beyond the rear of the waistband region 14 to the upper torso portion 22.

A second contemplated group of tension bands may comprise a pair of side torso bands 36. Each of the side torso bands 36 may extend laterally rearward from the perineum region 16, upward and around a respective side of the lower torso portion 12 of the swimsuit 10, and extending at least to the waistband region 14 on the front of the swimsuit. In certain embodiments, the side torso bands 36 may extend further beyond the front of the waistband region 14 and to the upper torso portion 22.

A third contemplated group of tension bands may comprise an inner thigh band 38. The inner thigh band may extend upward across along the inner thigh region 32 of one of the thigh portions 18, across the perineum region 16, and downward along the inner thigh region 32 of the other thigh portion 18. It may be seen that in certain embodiments, the inner thigh band 38 may be disposed interior to the inner thigh seam 30, and according to some embodiments, may serve as a gusset for strengthening that seam.

A fourth contemplated group of tension bands may comprise a pair of rear thigh bands 40. Each of the pair of rear thigh bands 40 may extend upward across a rear of a respective one of the thigh portions 18, across the lower torso portion 12, and at least to a rear of the waistband region 14. According to certain embodiments, such as the embodiment shown in FIGS. 1-5, the rear thigh bands 40 may extend further to the upper torso portion 22. In the embodiment shown in FIGS. 1-5, each rear thigh band 40 may turn outward at the upper torso portion 22 to extend to a respective side of the upper torso portion 22. According to certain embodiments, each of the pair of rear thigh bands 42 may additionally be connected to a respective one of the leg bands 20.

A fifth contemplated group of tension bands may comprise a pair of front thigh bands 42. Each of the pair of front thigh bands 40 may extend upward across a front of a respective one of the thigh portions 18, across the lower torso portion 12, and at least to the front of the waistband region 14. According to certain embodiments, each of the pair of front thigh bands 42 may additionally be connected to a respective one of the leg bands 20.

A sixth contemplated group of tension bands may comprise a pair of front torso bands 44. Each of the pair of front torso bands 44 may extend from the perineum region 16 at least to the front of the waistband region 14. In the exemplary embodiment, the front torso bands 44 may be configured in a "v" configuration and be disposed underneath the torso seam 28, and in this fashion may serve as a gusset for strengthening that seam. In embodiments with an upper torso portion 22, such as the embodiment illustrated by FIGS. 1-5, the front torso bands 44 may extend to that upper torso portion 22, where they may, for example, traverse the waistband region 14, traverse across a respective side of the upper torso portion 22, and extend to at least a rear of the upper torso portion 22.

It is additionally contemplated that a seventh group of tension bands may comprise a rear waistband tension band 46. The rear waistband tension band 46 may extend laterally along the rear of the waistband region 14 of the swimsuit. In the exemplary embodiment of FIGS. 1-5, each end of the rear waistband tension band 46 additionally extends around the side of the lower torso portion 12 at the waistband region 14, and subsequently extends to a front of the upper torso portion 22. According to specific embodiments, the ends of the rear waistband tension band 46 may then intersect at a front centerline of the upper torso portion 22, whereupon they may subsequently extend to at least an underarm region 24 of the upper torso portion 22.

Figure 8:
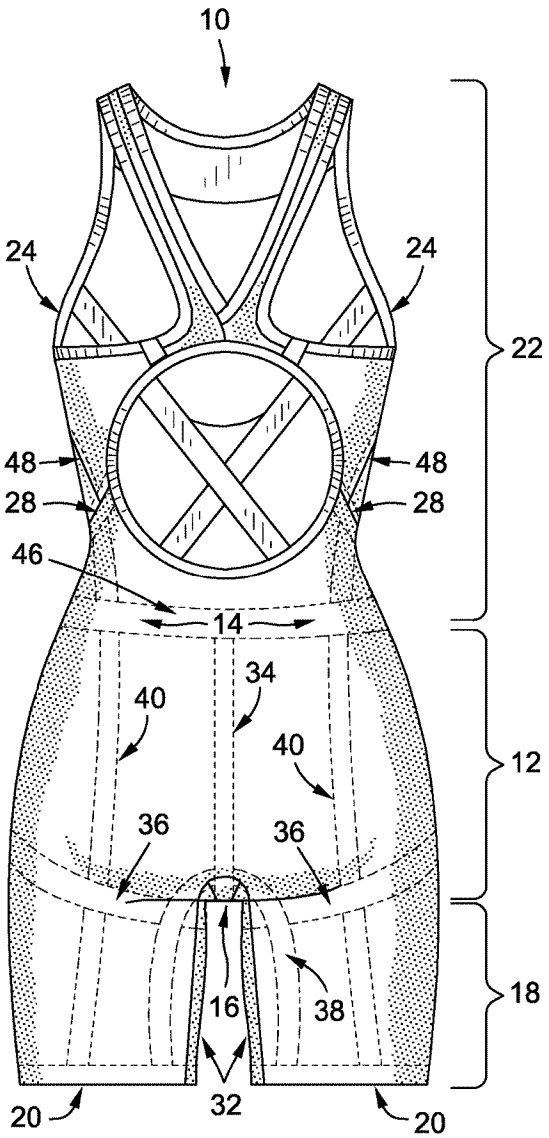
FIG. 8 is a back view of the racerback-style swimsuit embodiment shown in FIG. 7.
Figure 7:
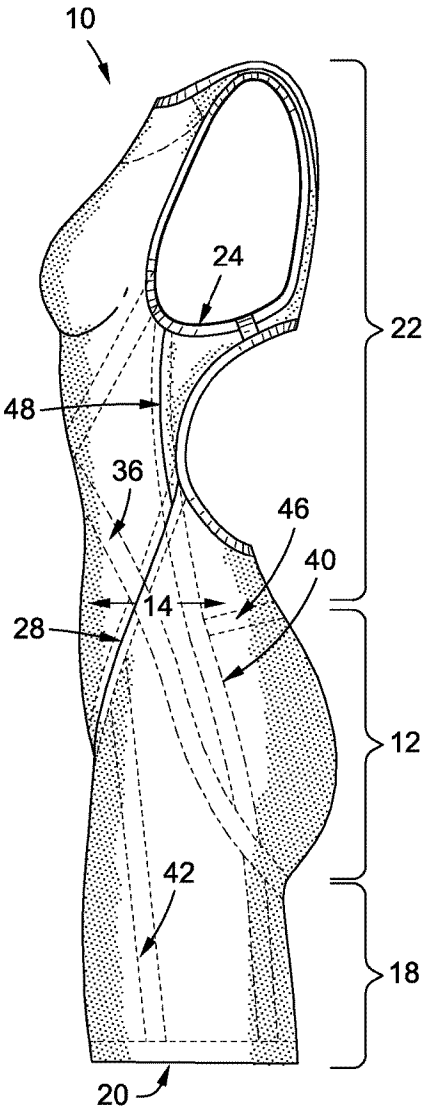
FIG. 7 is a side view of the racerback-style swimsuit embodiment shown in FIG. 6.
Figure 6:
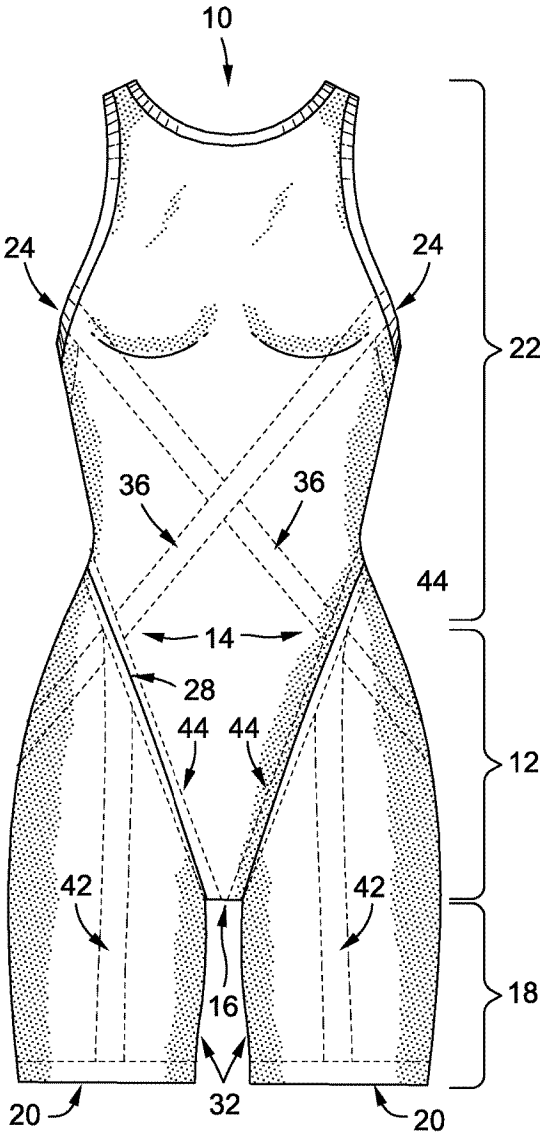
FIG. 6 is a front view of a second exemplary embodiment of a racerback-style swimsuit according to the present disclosure.

Turning now to FIGS. 6-8, a front, side, and rear view of an alternative embodiment of a razorback-style swimsuit 10 according to the presently contemplated disclosure are shown. It may be seen that this alternative embodiment, which is designed with a circular cut-out on the back, may utilize an alternative arrangement of tension bands and seams than the exemplary embodiment shown in FIGS. 1-5. Specifically, it may be seen that in this alternative embodiment, the torso seam 28 may terminate upon reaching the circular cut-out, and instead a side seam 48 may extend vertically upward from the torso seam 28 at the side of the upper torso portion 24, extending towards the underarm region 24. The tension bands may be configured different as well, with the side torso bands 36, instead of terminating at the waistband region 14, instead continuing into the upper torso portion 22, intersecting at a front centerline of the upper torso portion 22, and subsequently extending to at least the underarm region 24. The rear thigh bands 40, in this alternative embodiment, traverse the waistband region 14, traverse across a respective side of the upper torso portion 22, and extend to the underarm region 24. It may also be seen that after intersecting with the side torso bands 36, the rear thigh bands 40 may follow the path of the side seam 48, serving as a gusset for that seam. The rear waistband tension band 46, instead of continuing into the upper torso portion 22 as in the exemplary embodiment shown in FIGS. 1-5, may instead be limited to the lower torso portion 12. It may be seen, however, that the feature of the seamless rears of the lower torso portion 12 and the thigh portions 18, and the junction therebetween remains in place.

Figures 9, 10, 11:
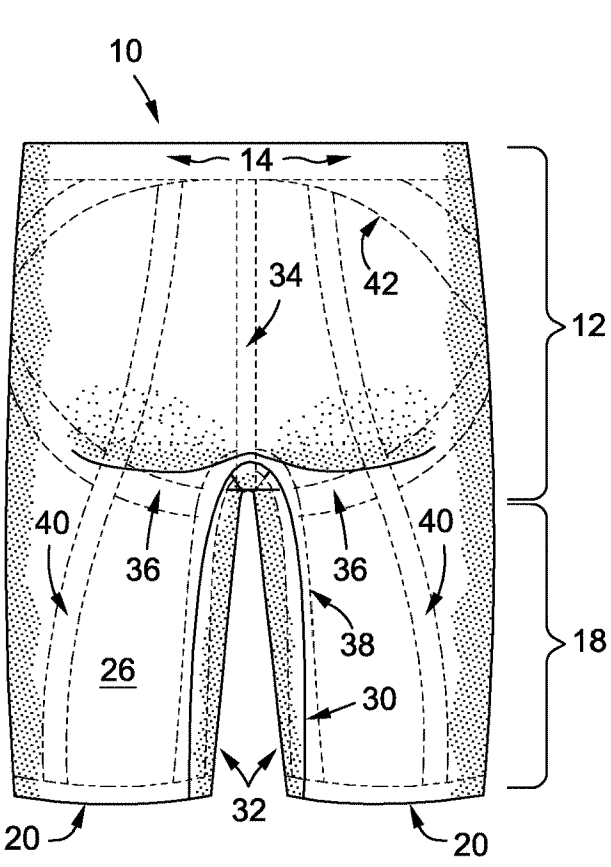
FIG. 9 is a front view of an exemplary embodiment of a jammer-style swimsuit according to the present disclosure.
FIG. 10 is a side view of the jammer-style swimsuit shown in FIG. 9.
FIG. 11 is a rear view of the jammer-style swimsuit shown in FIG. 9.

Turning now to FIGS. 9-11, a front, side, and rear view of a jammer style embodiment of a swimsuit 10 according to the presently contemplated disclosure are shown, with this jammer style embodiment being limited to a lower torso portion 12 and a thigh portion 18, without having an upper torso portion 22. According to this jammer style embodiment, it may be seen that the configuration of tension bands may differ from either of the previously discussed razorback style embodiments, but may still be within the scope and spirit of the present disclosure. For example, it may be seen that in the jammer-style embodiment, each front thigh band 42 may extend to the leg band 20 at an area more proximal to the inner thigh region 32, traverse the front of the thigh portion 18, extend around the side of the lower torso portion 12, and extend to the rear of the waistband region 14. It may also be seen that the side torso bands 36 may extend around the side of the lower torso portion, and extend to the front of the waistband region 14. The torso seam 28 may also be somewhat narrower than in the razorback style embodiments, and that the front torso bands 44 may follow the same contours of the torso seam 28. It may be seen, however, that the feature of the seamless rears of the lower torso portion 12 and the thigh portions 18, and the junction therebetween remains in place.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the exemplary embodiments.

What is claimed is:

1. A swimsuit having at least a lower torso portion and two thigh portions configured to be worn over and compress against at least part of the lower torso and the thighs of the swimmer, the swimsuit comprising:

an external surface, the external surface across a rear of the lower torso portion, a rear of the two thigh portions, and a junction therebetween being formed from a continuous, seamless external surface material; and at least three groups of tension bands disposed interior to the external surface of the swimsuit, each tension band within a group of tension bands having a longitudinal axis and being configured to have a tensile elasticity along the longitudinal axis greater than the tensile elasticity of the external surface material, the at least three groups of tension bands being chosen from among the following groups of tension bands:

a) a central rear band extending rearward from a perineum region of the swimsuit and vertically upward along the rear centerline of the lower torso portion;

b) a pair of side torso bands, each side torso band extending laterally rearward from the perineum region, upward and around a respective side of the lower torso portion, and at least to a front of a waistband region of the swimsuit;

c) an inner thigh band extending upward along an inner thigh region of one thigh portion, across the perineum region, and downward along the inner thigh region of the other thigh portion;

d) a pair of rear thigh bands, each rear thigh band extending upward along the rear of a respective one of the thigh portions, across the lower torso portion, and at least to a rear of the waistband region;

e) a pair of front thigh bands, each front thigh band extending upward across a front of respective one of the thigh portions and extends to the lower torso portion;

f) a pair of front torso bands, each front torso band extending from the perineum region at least to the front of the waistband region; and wherein the swimsuit is configured as a jammer style swimsuit.

2. The swimsuit of claim 1, wherein the at least three groups of tension bands includes the pair of front thigh bands, each front thigh band extending around the side of the lower torso portion and extending at least to a rear of the waistband region.

3. A swimsuit having at least a lower torso portion and two thigh portions configured to be worn over and compress against at least part of the lower torso and the thighs of the swimmer, the swimsuit comprising:

an external surface, the external surface across a rear of the lower torso portion, a rear of the two thigh portions, and a junction therebetween being formed from a continuous, seamless external surface material; and at least three groups of tension bands disposed interior to the external surface of the swimsuit, each tension band within a group of tension bands having a longitudinal axis and being configured to have a tensile elasticity along the longitudinal axis greater than the tensile elasticity of the external surface material, the at least three groups of tension bands being chosen from among the following groups of tension bands:

a) a central rear band extending rearward from a perineum region of the swimsuit and vertically upward along the rear centerline of the lower torso portion;

b) a pair of side torso bands, each side torso band extending laterally rearward from the perineum region, upward and around a respective side of the lower torso portion, and at least to a front of a waistband region of the swimsuit;

c) an inner thigh band extending upward along an inner thigh region of one thigh portion, across the perineum region, and downward along the inner thigh region of the other thigh portion;

d) a pair of rear thigh bands, each rear thigh band extending upward along the rear of a respective one of the thigh portions, across the lower torso portion, and at least to a rear of the waistband region;

e) a pair of front thigh bands, each front thigh band extending upward across a front of respective one of the thigh portions and extends to the lower torso portion;

f) a pair of front torso bands, each front torso band extending from the perineum region at least to the front of the waistband region; and wherein the swimsuit is configured as a square-leg style swimsuit.

* * * * *